United States Patent [19]

Niermeijer

[11] 4,377,016

[45] Mar. 22, 1983

[54] FOOTMAT

[75] Inventor: Anton G. A. Niermeijer, Arnhem, Netherlands

[73] Assignee: Vredestein N.V., Velp, Netherlands

[21] Appl. No.: 303,173

[22] Filed: Sep. 17, 1981

[51] Int. Cl.[3] ..... A47L 23/22; B32B 3/30

[52] U.S. Cl. ..... 15/215; 15/238; 296/1 F; 428/156; 428/167; 428/179

[58] Field of Search ..... 428/156, 179, 17, 167; 15/215, 217, 238; 296/1 F; 52/177, 180

[56] References Cited

U.S. PATENT DOCUMENTS

| | | | |
|---|---|---|---|
| 2,667,654 | 2/1954 | Peterson | 15/215 |
| 3,100,312 | 8/1963 | Williams | 15/215 |
| 3,616,104 | 10/1971 | Kuznick | 161/21 |
| 3,886,620 | 6/1975 | Miller et al. | 15/217 |

FOREIGN PATENT DOCUMENTS

| | | |
|---|---|---|
| 894403 | 2/1972 | Canada . |
| 1219084 | 5/1960 | France . |
| 1146527 | 3/1969 | United Kingdom . |

*Primary Examiner*—Paul J. Thibodeau

*Attorney, Agent, or Firm*—Diller, Ramik & Wight

[57] ABSTRACT

A shoe cleaning mat employs a plurality of spaced projections on a base layer, all projecting to substantially the same height to provide a stable support. Some of the projections are each provided with an array of radially extending ribs which are progressively deeper in the radially outward direction to provide corresponding increasing elasticity. Two different sizes of such projections are employed and a third type of projection, smaller than the other two, is provided with vertically extending side ribs which are progressively deeper in upward direction.

7 Claims, 4 Drawing Figures

FIG. 1
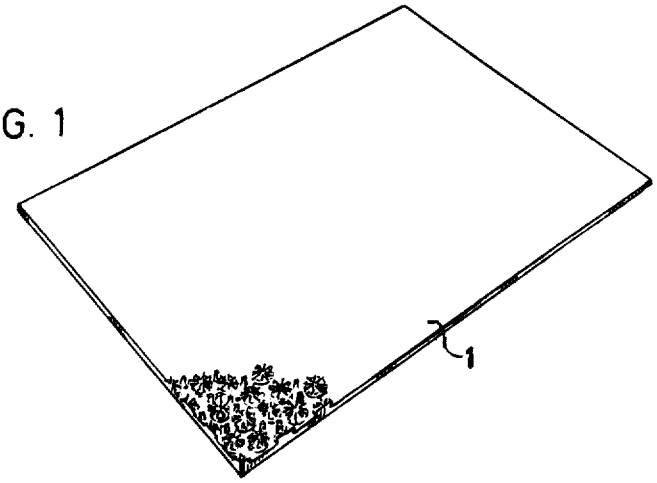
FIG. 2
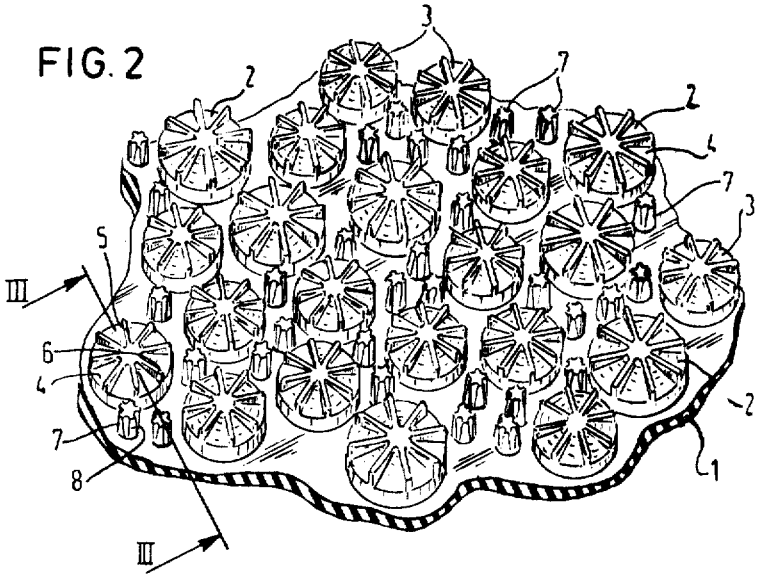
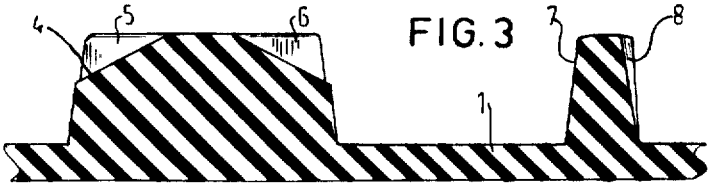
FIG. 3
FIG. 4
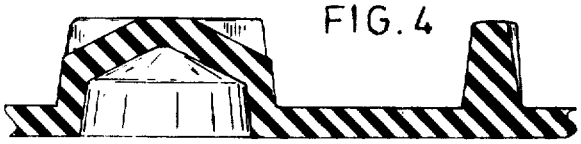

FOOTMAT

The invention relates to a foot mat of rubber or a synthetic resin comprising a flat supporting layer and profile elements protruding therefrom.

BACKGROUND OF THE INVENTION

A satisfactorily functioning foot mat has to satisfy inter alia the following requirements. In the first place it must be possible for the user to rapidly and particularly effectively clean his shoes in any position from all kinds of dirt and stones. The profile of the mat has to be such that one can walk and stand comfortably in a stable manner on the mat. Furthermore, that mat should have a great absorption capacity for dirt. A further requirement is that the mat should readily release the dirt, for example, when being shaken. Finally, particularly when the mat has to be used outdoor it is important to avoid mositure concentrations.

BRIEF DESCRIPTION OF THE INVENTION

According to the invention the aforesaid purposes are achieved by forming the profile elements in the shape of piles having ribs on the top side extending radially from the centre of the pile.

The mat according to the invention has a very high cleaning capacity because both the piles and the radially extending ribs have a scraping effect in all directions. There is no preferential direction in using the mat. Owing to the conical shape of the top surfaces of the piles the radial ribs are more elastic at the end parts than near the centre. This improves, as a matter of course, the cleaning effect for dirt and stones of any kind.

In order to further enhance the cleaning of the mat pin-shaped profile elements can protrude between the piles from the supporting layer, said pins having in particular a brushing function. The pin-shaped profile elements preferably have longitudinal ribs. The eleasticity of the pins is, of course, greater than that of the piles. Owing to this elasticity difference of the profile elements a very satisfactory, overall cleaning effect of the mat is obtained. Since in a preferred embodiment the top surface of the pile is substantially conical, water can flow down from the top of the pile.

The horizontal sectional area of the piles preferably differs in size.

The invention will be explained with reference to a drawing of an embodiment and a variant.

DETAILED DESCRIPTION OF THE DRAWING FIGURES

The drawing show in

FIG. 1 a perspective plan view of the foot mat embodying the invention,

FIG. 2 a perspective plan view on an enlarged scale of part of the mat of FIG. 1, FIG. 3 a sectional view taken on the line III—III in FIG. 2, FIG. 4 a detail of a variant of the mat embodying the invention.

DETAILED DESCRIPTION OF THE INVENTION

The mat according to the invention comprises a flat supporting layer 1 and profile elements protruding therefrom in the form of substantially conical piles or projections of different sizes 2 and 3 having at the top conical surfaces 4 with radially extending ribs 5 and 6. Furthermore, pin-shaped profile elements or projections 7 having longitudinal ribs 8 are protruding. The flutes between the ribs 8 are of progressively greater depth upwardly from the layer 1, as shown in FIGS. 3 and 4. Owing to the conical shape of the top surface 4 the end parts of the radial ribs 5 and 6 are more elastic than the central part. That is to say, the ribs 5 and 6 are of progressively greater depth and elasticity in the radial outward direction but merge centrally of the pile or projection in a central, solid part.

As a matter of course, the piles having a smaller horizontal sectional area and in particular the pin-shaped profile elements 7 are more elastic than the large piles 2. This array provides a very satisfactory scraping and brushing effect owing to the combination of flexible profile elements and more rigid profile elements. The dirt is collected in between the profile elements. The accumulated dirt can be readily released by shaking the mat.

The intervals in the array of the piles of different sectional areas and of the pin-shaped profile elements are such that the foot (both the sole and the heel) always stands on a number of differently shaped profile elements. This load distribution provides a stable position of the foot, which results in a comfortable walk and stand. In the embodiment of FIGS. 1 and 2 the array is at random.

The mat according to the invention has a high degree of flexibility and dirt releasing capacity because the piles are at comparatively large distances from one another. On the other hand the cleaning capacity is ensured by the presence of the pin-sahped profile elements in the free interstices between the piles. The dirt releasing capacity is even enhanced by the tapering shape of the profile elements.

FIG. 4 shows a profile element having a cavity which is open on the underside. A mat according to the invention having at least a plurality of such profile elements has a reduced weight and is cheaper, whilst in addition slipping on smooth substrates is less likely to occur.

It will be obvious that the hardness or other properties of the material can be chosen with regard to a given application.

It should finally be noted that the mat according to the invention is very simple and hence can be manufactured at low costs.

I claim:

1. A foot mat of flexible, resilient material and comprising a base layer having a predetermined size and contour, and a plurality of discrete and mutually spaced projections integrally formed with and upstanding from said base layer, the projections being distributed over the area encompassed by said base layer and each rising to substantially the same height above the base layer whereby to present an interrupted but stable shoe-supporting arrangement elevated above the base layer with the spaces between the projections presenting debris-collecting regions, at least some of said projections having an array of radially extending ribs integrally formed therewith, the ribs of each such array being of progressively greater depth in the radial outward direction thereof, whereby to possess increasing elasticity in such radial outward direction and the ribs of each such array merging centrally of the associated projection in a solid, central part thereof.

2. A foot mat as defined in claim 1 wherein some of those projections provided with an array of radially extending ribs are of a relatively large plan view cross sectional area whereas others are of a smaller plan view area.

3. A foot mat as defined in claim 1 or 2 wherein some of said projections are vertically fluted to present upstanding side ribs extending upwardly from said base layer, the depth of the flute progressively increasing upwardly from said base layer.

4. A foot mat as defined in claim 3 wherein the vertically fluted projections are of substantially smaller plan view cross sectional area than any of the projections having an array of radially extending ribs.

5. A foot mat as defined in claim 3 wherein each of said projections is of frusto-conical vertical shape.

6. A foot mat as defined in claim 4 wherein each of said projections is of frusto-conical vertical shape.

7. A foot mat as defined in claim 1 or 2 wherein each of said projections is of frusto-conical vertical shape.

* * * * *